United States Patent [19]

Eggert

[11] Patent Number: 4,827,560

[45] Date of Patent: May 9, 1989

[54] LOCK FOR LID OF VACUUM CLEANER CANISTER

[75] Inventor: Thomas F. Eggert, Boyle County, Ky.

[73] Assignee: Whirlpool Corporation, Benton Harbor, Mich.

[21] Appl. No.: 48,377

[22] Filed: May 11, 1987

[51] Int. Cl.[4] ..... A47L 5/00

[52] U.S. Cl. ..... 15/327 R; 15/323; 220/307

[58] Field of Search ..... 15/320, 323, 327 F, 15/327 R, 377; 285/7; 292/DIG. 38, 87; 206/320; 220/307, 324, 326

[56] References Cited

U.S. PATENT DOCUMENTS

| | | | |
|---|---|---|---|
| 922,852 | 5/1909 | Cannan | 292/87 |
| 2,217,097 | 10/1940 | Brooks | 220/324 |
| 2,335,031 | 11/1943 | Stevens | 15/327 F |
| 3,284,834 | 11/1966 | Waters | 15/323 |
| 3,438,081 | 4/1969 | Ruzzier | 15/327 R |
| 3,778,863 | 12/1973 | Westergren et al. | 15/323 |
| 4,118,616 | 10/1978 | Wittkamp et al. | 220/326 |
| 4,474,305 | 10/1984 | Marco | 220/307 |
| 4,554,700 | 11/1985 | Lyman | 15/323 |
| 4,597,130 | 7/1986 | Lyman | 285/7 |
| 4,715,083 | 12/1987 | Harris et al. | 15/323 |

*Primary Examiner*—Harvey C. Hornsby
*Assistant Examiner*—Corinne M. Reinckens
*Attorney, Agent, or Firm*—Wood, Dalton, Phillips Mason & Rowe

[57] ABSTRACT

A locking structure for releasably retaining a vacuum cleaner canister lid in closed position across a tool storage space in the hood portion of the canister. An arrangement of cooperating surfaces on the lid and hood is provided for permitting automatic latching of the lid in the closed position while permitting facilitated movement of the lid to an open position by a user when desired. The surfaces are defined by portions of the lid and hood formed integrally therein for low cost manufacture of the latching system.

18 Claims, 1 Drawing Sheet

FIG. 1
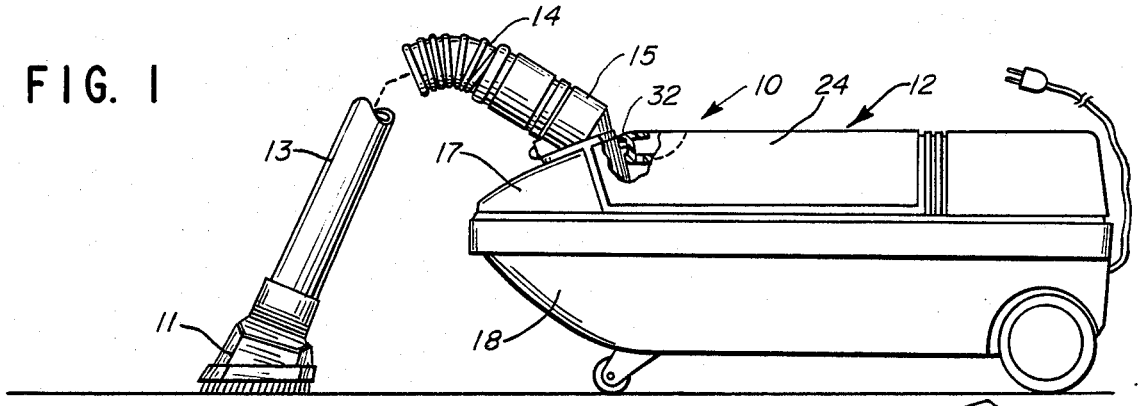
FIG. 2
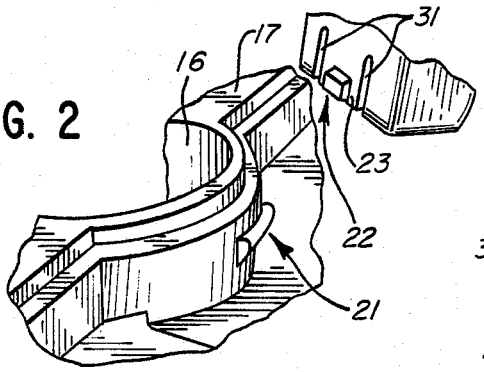
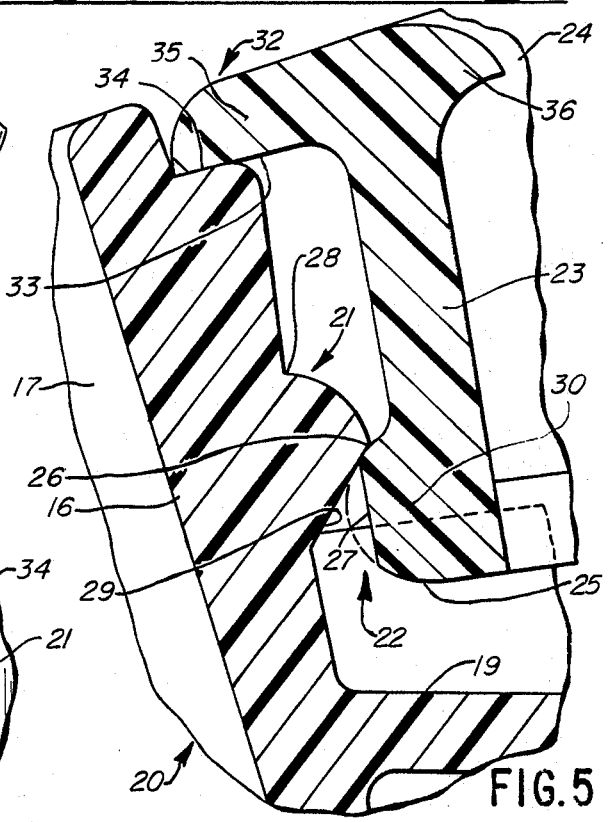
FIG. 5
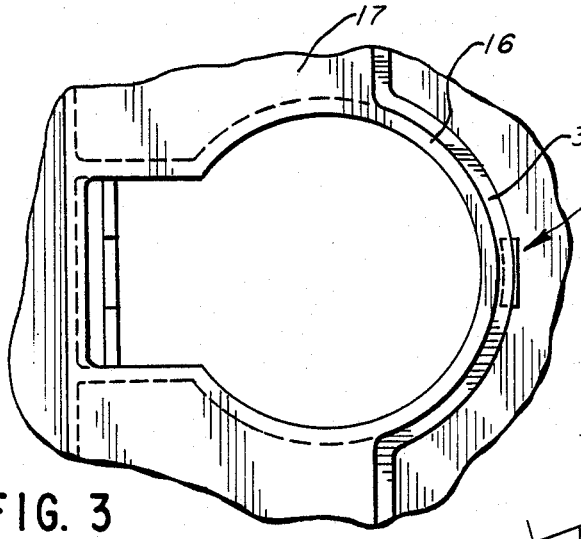
FIG. 3
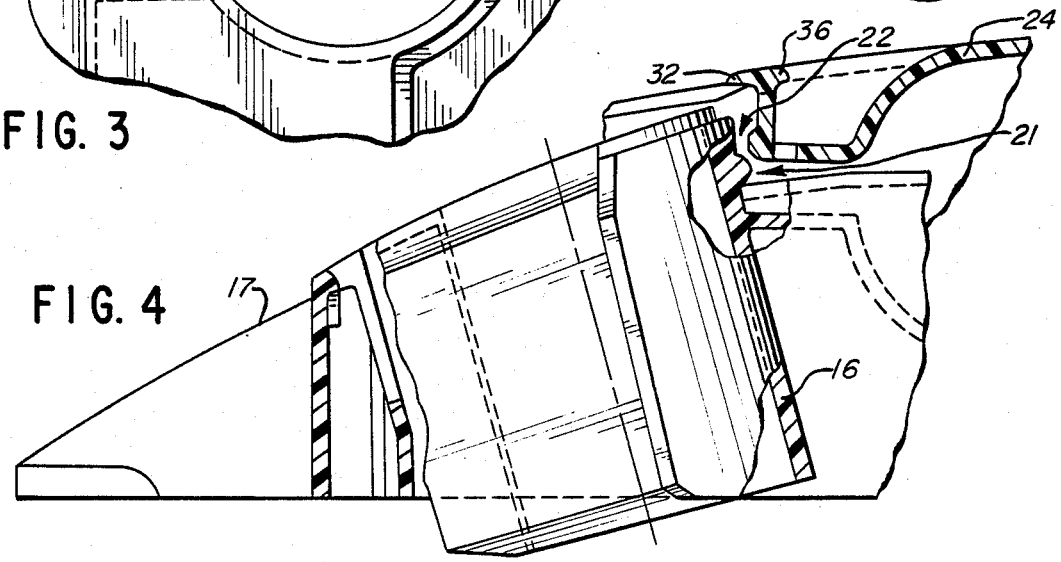
FIG. 4

LOCK FOR LID OF VACUUM CLEANER CANISTER

TECHNICAL FIELD

This invention relates to vacuum cleaner structures and in particular to improved means for releasably latching a lid in closed position with respect to a hood of a canistertype vacuum cleaner.

BACKGROUND ART

In one form of vacuum cleaner, a canister houses air suction means for drawing dirt-laden air through a nozzle and interconnecting hose into a filter bag mounted within the body of the canister. Access to the filter bag is provided by means of a pivotally mounted hood selectively exposing the filter bag space within the canister body.

In one improved form of such canister structure, the hood defines an upwardly opening tool storage space in which a number of different hose attachments and the like are stored for selective use by the operator of the vacuum cleaner. The tool storage space is selectively closed by a lid which is pivotally mounted for selective closure of the tool storage space.

One excellent example of a canister-type vacuum cleaner having such a hood and lid assembly is illustrated in U.S. Pat. No. 4,554,700 of John B. Lyman, which patent is owned by the assignee hereof.

As disclosed in U.S. Pat. No. 4,554,700, cooperating latch means may be provided on the lid and hood for selectively retaining the lid in the closed position across the tool storage space, while permitting swinging of the lid to an open disposition providing access to the tool stored in the storage space, when desired.

DISCLOSURE OF INVENTION

The present invention comprehends an improved means for releasably latching such a lid in the closed position in such a vacuum cleaner structure.

The latching means of the present invention is extremely simple and economical of construction.

The latching means of the invention may be formed integrally with the lid and hood members as by being molded integrally therewith from synthetic resin.

In the illustrated embodiment, the latching means includes a catch projecting toward the tool storage space, the catch having a rounded upper guide surface and a flat lower catching surface, and a resiliently deflectible latch disposed on the lid. The latch engages the catch in the closed position of the lid and includes a rounded lower guide surface portion, a rounded upper latching surface portion, and a relieved mid-surface portion.

The lower guide surface portion of the latch initially slidably engages the upper guide surface of the catch to resiliently deflect the latch as the lid is moved from the open position toward the closed position.

The relieved mid-surface portion of the latch permits further movement of the latch downwardly toward the closed position free of substantial further deflection of the latch and the upper latching surface is resiliently urged into underlying relationship with the lower catching surface of the catch when the lid is disposed fully in the closed position.

In the illustrated embodiment, the catch is provided on a suction inlet portion of the hood adapted to removably receive a vacuum cleaner hose end.

In the illustrated embodiment, the mid-surface portion of the latch is substantially planar and the upper and lower latch surfaces are segmentally cylindrical. More specifically, the upper and lower latch surfaces are coaxially segmentally cylindrical in the illustrated embodiment.

The upper guide surface of the catch is segmentally cylindrical.

The hood and lid further define cooperating shoulder means for maintaining the upper latching surface of the latch in engagement with the lower catch surface in the closed position of the lid.

The shoulder means, in the illustrated embodiment, includes an upwardly facing shoulder on the hood and a downwardly facing shoulder on the lid engaging the hood shoulder when the upper latching surface moves to below the upper guide surface of the catch.

In the illustrated embodiment, the shoulders are substantially planar and in facial engagement when the lid is in the closed position.

The lid defines a deflectible tongue and the latch comprises a projection on the tongue.

The lid further includes a resiliently projecting lip defining the downwardly facing shoulder.

In the illustrated embodiment, the lid and hood are formed of synthetic resin and the tongue and lip are formed unitarily integrally therewith.

The latching means of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a fragmentary side elevation of a canister vacuum cleaner having improved lid latching means embodying the invention;

FIG. 2 is a fragmentary exploded perspective view illustrating the cooperation between the lid latch and the hood catch portions of the latching means;

FIG. 3 is a fragmentary top plan view of a portion of the hood provided with the catch;

FIG. 4 is a fragmentary side elevation partially in section illustrating the arrangement of the latching means with the lid in a partially opened position; and FIG. 5 is a fragmentary enlarged vertical section illustrating the relationship of the latch and catch of the latching means in the closed disposition of the lid.

BEST MODE FOR CARRYING OUT THE INVENTION

In the exemplary embodiment of the invention as disclosed in the drawing, a vacuum cleaner generally designated 10 has a nozzle 11 connected to a canister 12 by an interconnected wand 13 and flexible hose 14.

The end of the hose connected to the canister defines a swivel connector 15 removably connected to a suction inlet portion 16 of a hood 17 pivotally mounted to a wheeled body 18 of the canister.

Hood 17 defines an upwardly opening tool storage space 19, as shown in FIG. 5, which is selectively closed by lid 12, as illustrated in FIG. 1. The present invention is concerned with the provision of improved means for releasably latching the lid to the hood in the closed position of FIG. 1. More specifically, the invention comprehends the provision of an improved latching means generally designated 20, which, as shown in FIG. 5, includes a catch generally designated 21 formed integrally with the suction inlet portion 16 of the hood 17 and a latch generally designated 22 integrally associated with a deflectible portion 23 of the lid 24.

As best seen in FIG. 5, latch 22 includes a rounded lower guide surface portion 25, a rounded upper latching surface portion 26, and a relieved mid-surface portion 27.

The catch 21 includes a rounded upper guide surface 28 and a flat lower catching surface 29.

With reference to the illustrations of FIG. 4 and 5, the latching means 20 permits facilitated latching of the lid to the hood by the simple downward urging of the lid into overlying relationship with the hood of the closed position, while yet permitting ready movement of the lid from the closed position to an open position wherein access to tool stored in the space 19 may be had. Thus, the lower guide surface portion 25 of the latch initially slidably engages the upper guide surface 28 of the catch to resiliently deflect the latch as the lid is moved downwardly from the open position toward the closed position.

The relieved mid-surface portion 27 of the latch permits further movement of the latch toward the closed position free of substantially further deflection of the latch.

The upper latching surface 26 of the latch is resiliently urged into underlying relationship with the lower catching surface 29 of the catch when the lid is disposed fully in the closed position, as illustrated in FIG. 5.

As shown in FIG. 5, the mid-surface portion 27 of the illustrated embodiment is substantially planar, and the lower catching surface 29 of catch 21 is substantially planar. The upper latching surface 26 is segmentally cylindrical, and the lower guide surface 25 of the latch is segmentally cylindrical. In the illustrated embodiment, the surfaces 25 and 26 extend coaxially of a common axis 30.

In the illustrated embodiment, the upper guide surface 28 of the catch is segmentally cylindrical.

Resilient deflectibility of the latch structure 22 is provided, in the illustrated embodiment, by means of a pair of slits 31 at opposite sides of the deflectible lid portion 23 carrying the protuberant latch means, as illustrated in FIG. 2. The lid 24 may be formed of a suitable resilient material, such as molded synthetic resin, providing the desired resilient deflectibility.

The vacuum cleaner structure further includes retaining means generally designated 32 for maintaining the upper latching surface 26 in engagement with the lower catch surface 29 in the closed position of the lid. The retaining means includes operating shoulder means 33 on the lid 24 and shoulder means 34 on the hood 17. More specifically, shoulder means 34 defines an upwardly facing flat surface on a portion of the suction inlet 16. Shoulder means 33 is defined by a downwardly facing surface on a projecting portion 35 adjacent lid deflectible portion 23. Surfaces 33 and 34 engage facially when the upper latching surface 26 is moved to below the upper guide surface 28 of the catch and into engagement with the lower catching surface 29 thereof, as illustrated in FIG. 5. Projection 35 comprises a resiliently deflectible lip on the hood portion 23. Surface 33 is spaced from surface 26 of the latching means suitably to assure maintained association of surface 26 with catch surface 29 when retaining surface 33 is in facial abutment with surface 34, as shown.

As further illustrated in FIG. 5, lid 24 further defines a manipulating portion 36 comprising a projection extending oppositely to projection 35 and adapted for engagement by a user's fingers for moving the lid from the closed position of FIG. 5, when desired.

Thus, the cooperating shoulder surfaces 26, 29, 33 and 34 effectively releasably lock the lid in the closed position of FIG. 1 as a result of the user moving the lid to that position. The lid is captured against vertical displacement by the cooperating shoulders notwithstanding vibration and jarring occurring in the normal us of the canister.

However, when it is desired to move the lid to the open position so as to provide access to the tool storage space 19, the user need merely engage his fingers with the manipulating tongue 36 and lift the associated portion of the lid so as to provide the desired access to space 19.

The configurations of the latch and catch surfaces is preselected to provide automatic latching and facilitated release when desired.

The foregoing disclosure of specific embodiments is illustrative of the broad inventive concepts comprehended by the invention.

I claim:

1. In a vacuum cleaner canister having a body, a hood overlying the body and defining an upwardly opening tool storage space and a pivotally mounted lid overlying said storage space in a closed position and being selectively movable to an open position for providing selective access to attachment tools and the like stored in said storage space, improved means for releasably latching the lid in said closed position comprising:

a catch projecting toward said storage space, said catch having a rounded in cross section upper guide surface and a rectilinear in cross section lower catching surface; and resiliently deflectible latch disposed on said lid, said latch engaging said catch in said closed position of the lid, and having a rounded in cross section lower guide surface portion, a rounded in cross section upper latching surface portion, and a relieved mid-surface portion, when said lower guide surface portion of the latch initially slidably engaging said upper guide surface of the catch to resiliently deflect the latch as the lid is moved from said open position toward said closed position, said relieved mid-surface portion of the latch permitting further movement of the latch toward said closed position free of substantial further deflection of the latch, and said upper latching surface being resiliently urged into underlying relationship with said lower catching surface of the catch when the lid is disposed in said closed position.

2. The vacuum cleaner canister structure of claim 1 wherein said mid-surface portion of the latch is substantially planar.

3. The vacuum cleaner canister structure of claim 1 wherein said upper latching surface of the latch is segmentally cylindrical.

4. The vacuum cleaner canister structure of claim 1 wherein said lower guide surface portion of the latch is segmentally cylindrical.

5. The vacuum cleaner canister structure of claim 1 wherein said upper latching surface and lower guide surface of the latch are coaxially segmentally cylindrical.

6. The vacuum cleaner canister structure of claim 1 wherein said upper guide surface of the catch is segmentally cylindrical.

7. In a vacuum cleaner canister having a body, a hood overlying the body and defining an upwardly opening tool storage space and a pivotally mounted lid overlying said storage space in a closed position and being selectively movable to an open position for providing selective access to attachment tools and the like stored in said storage space, improved means for releasably latching the lid in said closed position comprising:

a catch projecting toward said storage space, said catch having a rounded in cross section upper guide surface and a rectilinear in cross section lower catching surface;

a resiliently deflectible latch disposed on said lid, said latch engaging said catch in said closed position of the lid, and having a rounded in cross section lower guide surface portion, a rounded in cross section upper latching surface portion, and a relieved mid-surface portion, said lower guide surface portion of the latch initially slidably engaging said upper guide surface of the catch to resiliently deflect the latch as the lid is moved from said open position toward said closed position, said relieved mid-surface portion of the latch permitting further movement of the latch toward said closed position free of substantial further deflection of the latch, and said upper latching surface being resiliently urged into underlying relationship with said lower catching surface of the catch when the lid is disposed in said closed position; and cooperating shoulder means on said lid and said hood for maintaining said upper latching surface in engagement with said lower catching surface in said closed position.

8. The vacuum cleaner canister structure of claim 7 wherein said shoulder means includes an upwardly facing shoulder on said hood and a downwardly facing shoulder on said lid engaging said upwardly facing shoulder when said upper latching surface moves to below said upper guide surface of the catch and into engagement with said lower catching surface thereof.

9. The vacuum cleaner canister structure of claim 7 wherein said shoulder means includes an upwardly facing shoulder on said hood and a downwardly facing shoulder on said lid facially engaging said upwardly facing shoulder when said upper latching surface moves to below said upper guide surface of the catch and into engagement with said lower catching surface thereof.

10. The vacuum cleaner canister structure of claim 7 wherein said shoulder means includes an upwardly facing planar shoulder on said hood and a downwardly facing planar shoulder on said lid facially engaging said upwardly facing shoulder when said upper latching surface moves to below said upper guide surface of the catch and into engagement with said lower catching surface thereof.

11. The vacuum cleaner canister structure of claim 7 wherein said lid includes a projecting lip having a lower surface defining said downwardly facing shoulder.

12. The vacuum cleaner canister structure of claim 7 wherein said lid includes a resiliently deflectible projecting lip having a lower surface defining said downwardly facing shoulder.

13. The vacuum cleaner canister structure of claim 1 wherein structure is associated with said shoulder means defining a manipulating means for engagement by a user's fingers for moving said lid from said closed position.

14. The vacuum cleaner canister structure of claim 7 wherein said lid defined a deflectible tongue and said latch comprises a projection on said tongue.

15. The vacuum cleaner canister structure of claim 7 wherein said lid defined a deflectible tongue and said latch comprises a projection on said tongue, said lid being formed of synthetic resin and said tongue and lip being formed unitarily integrally therewith.

16. The vacuum cleaner canister structure of claim 7 wherein said canister includes wall means defining a suction inlet for releasably receiving a vacuum cleaner hose end.

17. In a vacuum cleaner canister having a body, a hood overlying the body and defining an upwardly opening tool storage space and a pivotally mounted lid overlying said storage space in a closed position and being selectively movable to an open position for providing selective access to attachment tools and the like stored in said storage space, improved means for releasably latching the lid in said closed position comprising:

suction inlet means on said hood for releasably receiving a vacuum cleaner hose end and defining a catch projecting toward said storage space, said catch having a rounded in cross section upper guide surface and a rectilinear in cross section lower catching surface; and a resiliently deflectible latch disposed on said lid, said latch engaging said catch in said closed position of the lid, and having a rounded in cross section lower guide surface portion, a rounded in cross section upper latching surface portion, and a relieved mid-surface portion, said lower guide surface portion of the latch initially slidably engaging said upper guide surface of the catch to resiliently deflect the latch as the lid is moved from said open position toward said closed position, said relieved mid-surface portion of the latch permitting further movement of the latch toward said closed position free of substantial further deflection of the latch, and said upper latching surface being resiliently urged into underlying relationship with said lower catching surface of the catch when the lid is disposed in said closed position.

18. The vacuum cleaner canister structure of claim 17 wherein said catch is formed integrally with said suction inlet means.

* * * * *